United States Patent [19]

Hengstenberger et al.

[11] Patent Number: 4,854,418

[45] Date of Patent: Aug. 8, 1989

[54] SAFETY HARNESS

[76] Inventors: Gary M. Hengstenberger, 948 Impala Dr., Akron, Ohio 44319; John I. Montavon, 1000 Jean Ave., Akron, Ohio 44310

[21] Appl. No.: 58,124

[22] Filed: Jun. 4, 1987

Related U.S. Application Data

[63] Continuation-in-part of Ser. No. 832,326, Feb. 24, 1986, Pat. No. 4,682,671.

[51] Int. Cl.[4] ..... A65B 35/00

[52] U.S. Cl. ..... 182/3

[58] Field of Search ..... 182/3–7, 182/3; 244/151 R, 137 P; 119/96, 101

[56] References Cited

U.S. PATENT DOCUMENTS

| | | | |
|---|---|---|---|
| 1,440,151 | 12/1922 | Irvin | 244/151 R |
| 1,826,263 | 10/1931 | Stephens | 182/5 |
| 2,382,816 | 8/1945 | Quilter et al. | 244/151 R X |
| 2,464,719 | 3/1949 | Quilter | 244/151 R |
| 2,887,286 | 5/1959 | Moran | 244/151 X |
| 2,979,153 | 4/1961 | Hoagland et al. | 182/3 |
| 3,074,074 | 1/1963 | Lovering | 182/3 X |
| 3,738,449 | 6/1973 | Arancio | 182/7 |
| 4,177,877 | 12/1979 | Gallinati | 182/3 |
| 4,625,335 | 12/1986 | Vinai | 182/3 X |
| 4,645,033 | 2/1987 | Oelschlager | 182/6 |

*Primary Examiner*—Alvin C. Chin-Shue

[57] ABSTRACT

A safety harness consisting of a continuous loop of strong material is stitched to form a larger torso loop and a smaller handle loop. The torso loop is maintained between the outer shell and inner liner of a service jacket and is positioned to loop behind the wearer's back, under his arms, and over his shoulders such that the handle loop extends from a hole in the base of the neck of the outer shell. The handle loop is removably secured to the exterior of the outer shell by a quick-release fastener. In another embodiment, the handle loop extends through a hole in the inner lining to be maintained adjacent the wearer's neck, preserving the integrity of the outer shell. In a still further embodiment, a lifting strap is looped over the rear of the harness, passed between the legs of the wearer, and fastened to the harness at the sides of the wearer, facilitating the wearer's vertical hoisting.

1 Claim, 3 Drawing Sheets

SAFETY HARNESS

CROSS REFERENCE TO RELATED APPLICATION

This application is a continuation-in-part of our copending application, Ser. No. 832,326, filed Feb. 24, 1986, now U.S. Pat. No. 4,682,671 issued 7-28-1987.

TECHNICAL FIELD

The invention herein resides in the art of safety apparatus and, more particularly, to a safety harness or belt which is adapted for inclusion with a service jacket.

BACKGROUND ART

Rescue workers such as firemen, paramedics and police officers, as well as construction workers, military personnel, and the like often find themselves in perilous situations where they themselves require rescue by companions or others. For example, if such an individual is overcome by smoke or fumes, or is otherwise incapacitated or immobilized, the prompt attention and rescue efforts of others is necessary to move the individual to safety and out of harm's way. This commonly involves dragging the individual from the location of danger, but it sometimes also involves hoisting or lowering the individual vertically.

Previously, rescue operations of an individual, particularly when the individual is incapacitated, has required the time-consuming operation of securing the individual with ropes, harnesses, or the like, or the seeking of additional manpower or help. However, the time used for obtaining assistance or actually securing the individual by means of a lifeline or rope is often times so excessive that it defeats the entire rescue operation. Individuals such as those above-mentioned are, by nature of their work, better served and protected by including a safety harness as part and parcel of their safety gear and apparel. Previously known safety harnesses have typically been bulky, cumbersome, or restrictive of the wearer and, accordingly, have not been favorably received by those for whom they are designed. Further, such safety harnesses have not been easily integrated into the wearer's apparel such that, except when actually needed for rescue, the harness is totally concealed and unobtrusive. Previously known safety harnesses and the like of the foregoing nature are shown and described in U.S. Pats. Nos. 4,161,266; 3,973,643; 2,699,284; 4,177,877; 4,545,773; 4,076,101; 4,194,257; and 4,273,216.

U.S. Pat. No. 3,074,074 teaches a hunter's jacket which includes a tow harness having a line or rope extending therefrom with which the wearer may drag game from the woods. The tow line leaves the jacket beneath the wearer's arms and, as such, is unsuitable for a safety harness. Similarly, the tow line is actually stored in a compartment on the back of the jacket, adding bulk, weight, and complexity to the unit as a whole, similarly making it unsuited as a safety device.

DISCLOSURE OF THE INVENTION

In light of the foregoing, it is a first aspect of the invention to provide a safety harness which is capable of reliably supporting heavy loads.

Another aspect of the invention is the provision of a safety harness which is easily accessed for securement by those seeking to effect a rescue.

A further aspect of the invention is the provision of a safety harness which may be constantly worn by the user, but without obtrusion.

Yet an additional aspect of the invention is the provision of a safety harness which may be made as an integral part of the wearer's apparel.

Still a further aspect of the invention is the provision of a safety harness which is self-tightening and securing upon the wearer.

Another aspect of the invention is the provision of a safety harness which maximizes leverage on the "dead weight" of an incapacitated wearer.

Another aspect of the invention is the provision of a safety harness which may be incorporated with a service jacket without impairing the integrity of the jacket.

Yet an additional aspect of the invention is the provision of a safety harness which is inexpensive to construct, easy to implement with virtually any jacket or outer garment, and which is reliable and durable in use.

A further important aspect of the invention is the provision of a safety harness lifting strap which assists would-be rescuers in lifting or lowering the affected individual vertically.

The foregoing and other aspects of the invention which will become apparent as the detailed description proceeds are achieved by safety apparatus, comprising:

a continuous loop of material connected to itself at a point to define a first larger loop and a second smaller loop; and a jacket receiving said continuous loop of material.

Other aspects of the invention are achieved by safety wearing apparel, comprising:

a jacket having a back portion, a neck portion, a front portion, and arms extending from side portions thereof; and a continuous loop of material received by said jacket and passing from said back portion to said front portion below a point where said arms extend from side portions, thence to said neck portion.

The foregoing and other aspects of the invention are also achieved by a safety apparatus comprising:

a continuous loop of material connected to itself at a point to define a first larger loop and a second smaller loop;

a lifting strap adapted to having the ends thereof looped over the part of said larger loop disposed at the rear of the wearer, and for having said ends fastened by connection means to said larger loop at the sides of said larger loop after passing between the legs of said wearer; and a jacket receiving said continuous loop of material.

DESCRIPTION OF THE DRAWINGS

For a complete understanding of the objects, techniques and structure of the invention reference should be had to the following detailed description and accompanying drawings wherein.

BEST MODE FOR CARRYING OUT THE INVENTION

Figure 1:
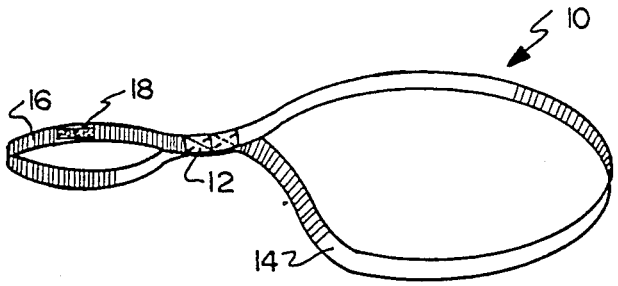
FIG. 1 is a perspective view of the continuous loop comprising the harness of the invention.

Referring now to the drawings and more particularly FIG. 1, it can be seen that the safety harness of the invention is designated generally by the numeral 10. Safety harness 10 is comprised of a continuous loop of material such as nylon, polyester, or Nomex (a trademark of DuPont), or other suitable material having sufficient strength and durability to function for the intended purposes. The continuous loop of the safety harness 10 is stitched as at 12 to define a larger torso loop 14 and a smaller handle loop 16, the functions of which will be discussed hereinafter. As further illustrated in FIG. 1, a hook and loop material 18 or other suitable quick-release fastener is provided on an outer surface of the handle loop 16 as shown.

Figure 2:
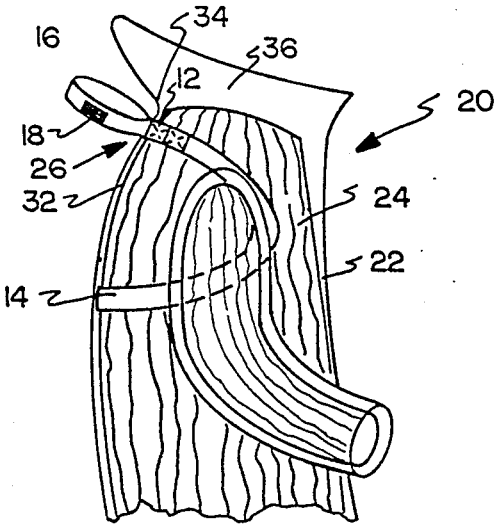
FIG. 2 is an illustrative phantom side view of a service jacket illustrating the incorporation of the safety harness therewith.

FIG. 2 illustrates the incorporation of the safety harness 10 of FIG. 1 in a service jacket 20 of the type typically worn by firemen and other rescue personnel. The service jacket 20 includes an outer liner or shell 22 and an inner liner 24 illustrated in checkerboard. The service jacket 22 is of a standard nature, modified only to the extent that a hole 26, on the order of a button hole, is interposed in the back of the jacket at the center of the neck, directly beneath the collar of the jacket. The hole 26 is typically of a length just slightly larger than the width of the material comprising the handle loop 16, to allow the loop 16 to extend therethrough. For purposes of strength and integrity, the hole 26 is stitched or otherwise reinforced about the periphery thereof like a button hole or, as will be discussed hereinafter, may comprise a grommet. It should again be noted that the loop 16 extends from the hole 26 at a point immediately above the shoulder area of the jacket 20 and within the neck area, centered in the back thereof.

Figure 3:
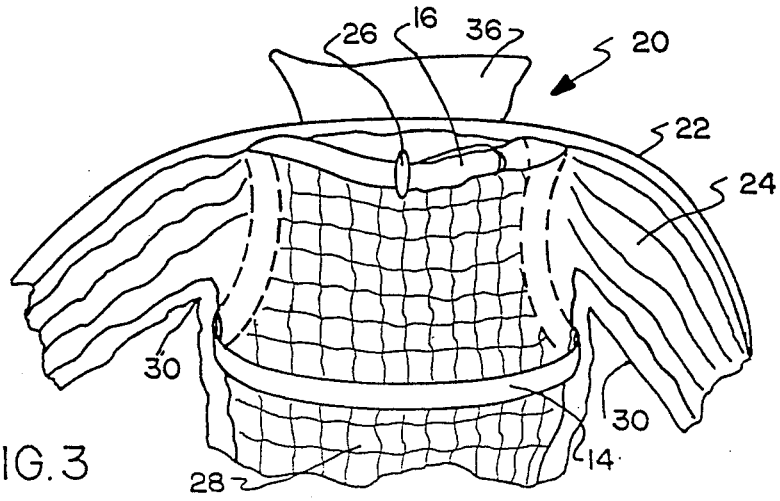
FIG. 3 is an illustrative phantom rear view of the structure of FIG. 2.

As further illustrated in FIGS. 2 and 3, it can be seen that the harness 10 is interposed between the outer shell 22 and the inner liner 24 of the service jacket 20. The torso loop 14 passes about the upper mid-back portion 28 of the jacket 20, under the armpits 30, over the shoulders 32, to the hole 26, from which extends the handle loop 16. The hook and loop or other fastening strip 18 on the loop 16 then mates with a corresponding fastening means on the jacket 20 beneath the collar 36. In such fashion, the loop 16 is concealed and protected from hooking or otherwise being secured by protrusions in the environment.

In use, if the wearer of the service coat 20 were found to be in need of rescue from a perilous situation, an individual may simply grab the handle loop 16 from beneath the collar 36, separate it by disengaging the fastening means 18 from the jacket 20, and drag the victim to safety by the handle loop 16. It will be understood that a pulling force on the handle loop 16 cinches or grips the wearer of the jacket 20 by placing opposing forces across the middle of the back and the front of the shoulders, assuring that maximum engagement of the victim is achieved by the harness 10.

By placing the handle loop 16 above the shoulder line of the wearer at the neck, as discussed above, the dragging and maneuvering operation is facilitated. Virtually all of the weight of the wearer extends behind the handle loop 16 as the wearer is being drug. The victim's body thus follows in a straight narrow line behind the force applied to the loop 16, with little twisting or contorting. In other words, the specific arrangement just described allows for ease of handling of "dead weight" of the victim.

It should be understood that the safety harness 10 may be inserted into any jacket, coat, or vest with or without a liner. The presence of the liner 24 totally conceals the harness 10, and guarantees that it is maintained in place. However, in the absence of the liner 22, guides or loops for positioning the harness 10 as just described may be interposed within the inside of the jacket to maintain the loop 10 in proper place. It should also be noted that the harness 10 operates independently of the garment which receives it since it is free to move with respect to the garment and is nowhere adhered to the garment. Further, the harness 10 does not interfere with the garment nor restrict the movement of the wearer in any way.

In operation, the harness 10 grips the upper torso of the wearer to provide ideal leverage for correct rescue procedure of dragging a victim along the axis of his skeletal frame to minimize further injury during rescue and to allow maneuvering along narrow pathways. This leverage is further enhanced by the positioning of the hole 26 at approximately the base of the neck of the wearer.

Figure 4:
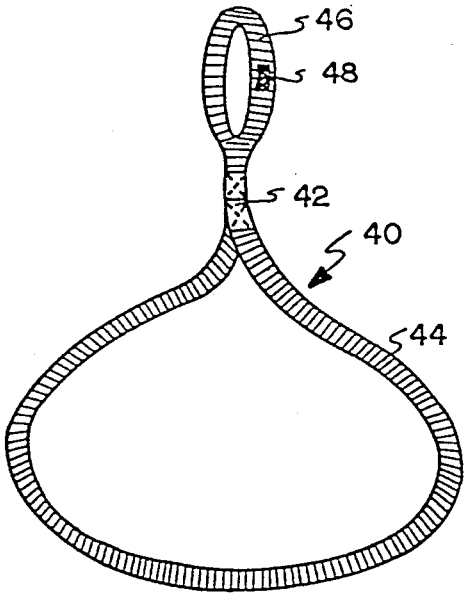
FIG. 4 is a perspective view of a second embodiment of the continuous loop comprising the harness of the invention.

With reference now to FIGS. 4–7, a second embodiment of the invention may be seen and understood. As shown in FIG. 4, a safety harness comprising a continuous loop of material is designated generally by the numeral 40. As with the embodiment of FIGS. 1–3, the material is of a suitable size, width and thickness to accomodate the intended purpose. The loop 40 is stitched or otherwise secured to itself as at 42 to define a larger torso loop 44 and a smaller handle loop 46. Hook and loop fasteners or other suitable fastening means 48 are provided on opposite sides of the smaller loop 46 on outer surfaces thereof.

Figure 5:
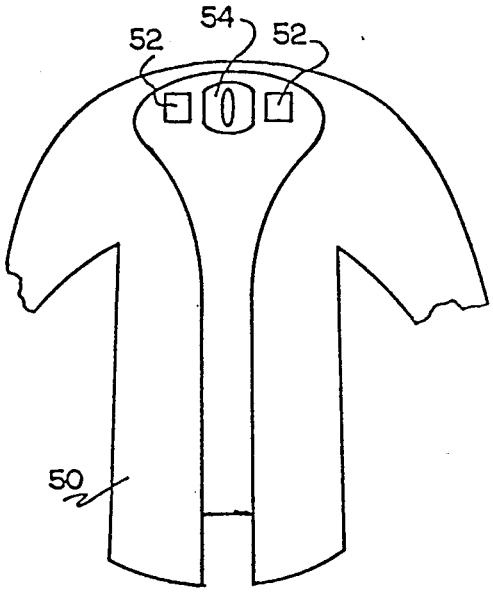
FIG. 5 is a front perspective view of the inner liner of a service jacket according to a second embodiment of the invention.

As shown in FIG. 5, the inner liner 50 of the service jacket is characterized by a pair of hook-and-loop patches or other mating fastening means to receive the fasteners 48. The fasteners or patches 52 are positioned on opposite sides of a buttonhole 54 passing centrally through the neck portion of the inner liner 50. Of course, the buttonhole 54 is stitched about the periphery thereof for purposes of reinforcement or the hole may actually be formed by means of placing a grommet thereat for the same purpose.

Figure 6:
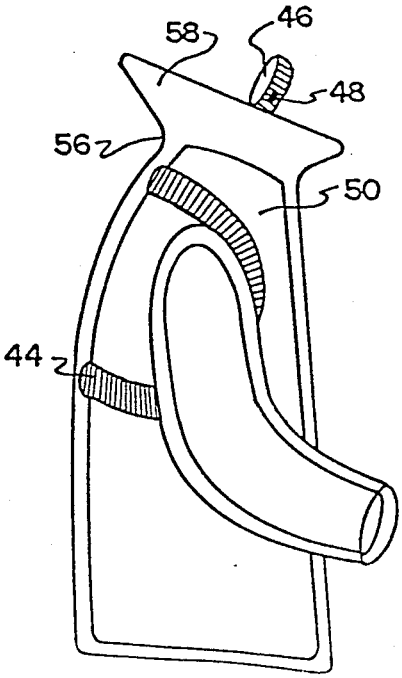
FIG. 6 is an illustrative phantom side view of a service jacket illustrating the incorporation of the safety harness according to a second embodiment of the invention.
Figure 7:
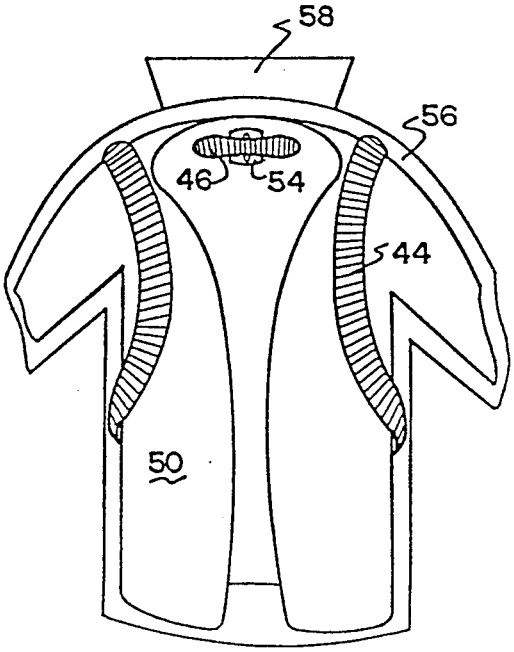
FIG. 7 is an illustrative front phantom view of the structure of FIG. 6.

The inner liner 50 of FIG. 5 is received within an outer shell of 56 in standard fashion as shown in FIGS. 6 and 7. As in the prior embodiment, the outer shell 56 would typically be characterized by a collar or the like 58. As with the prior embodiment, the torso loop 44 is maintained between the inner liner 50 and the outer shell 56. The torso loop 44 passes from the upper mid-back portion along the sides of the jacket toward the front thereof at a point immediately beneath the joinder of the arms with the body of the jacket. The loop 44 then passes over the shoulders and toward the back of the neck portion of the jacket with the handle loop 46 then passing through the buttonhole or grommet 54. The hook and loop fasteners 48 are then mated with the patches 52 such that the handle loop lies flat as shown in FIG. 7. In this embodiment, the integrity of the outer shell 56 is not comprimised since no hole or opening is interposed therein. The hole or opening is only provided in the inner shell such that the handle loop 46 is maintained immediately at the back of the neck of the wearer. Safety personnel, knowing of the presence of the safety harness, can simply reach into the inner shell, grasp the handle loop 46, pull it so as to disengage the fastening means 48, 52 and drag the victim to safety.

Figure 8:
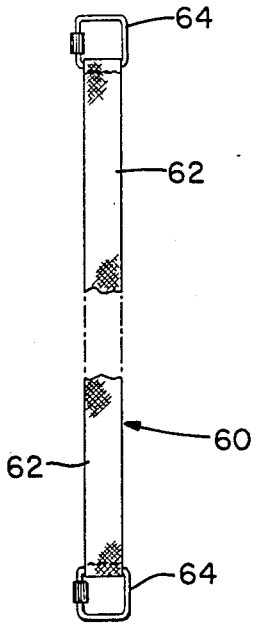
FIG. 8 is a prospective view of a lifting strap of the invention.

FIG. 8 is a perspective view of a lifting strap, shown generally by the numeral 60, comprising a belt portion 62, with connection means 64, carabiners being shown in the Figure, attached to each end thereof. As in the case of the continuous loop, the belt portion 62 may be made from any material such as nylon, polyester, or Nomex, as well as other suitable materials having sufficient strength and durability to function for the intended purposes. The connection means 64 may be selected from any of the wide variety of connectors, snaps, or buckles ordinarily used for fastening one strap to another; however, snap connectors are particularly useful since they facilitate easy and rapid use. Of such devices, carabiners are particularly preferred, since in addition to being easy to use, they incorporate means for locking the device to prevent inadvertant opening thereof. The length of lifting stap 60 may be varied within fairly broad limits, and will depend upon the size of the individual with whom the lifting strap is to be used. Ordinarily, however, it has been found that a length of from about 5 to 6 feet provides satisfactory results, even when the individual with whom the lifting strap is used is wearing bulky clothes, such as, for instance, the bunker pants used by fireman.

Figure 9:
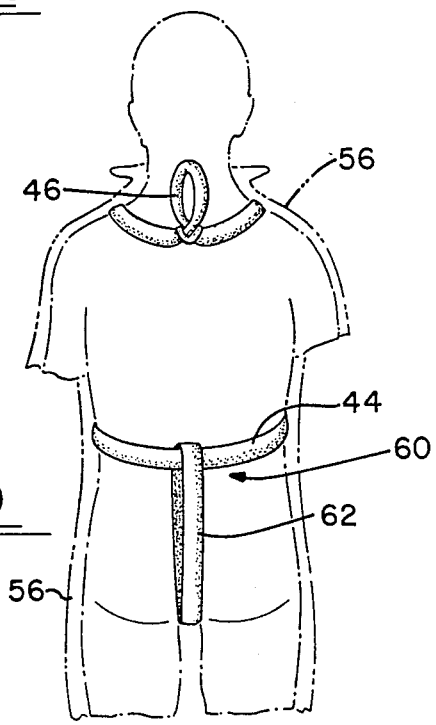
FIG. 9 is an illustrative phantom rear view of a service jacket showing a harness with a lifting strap.

FIG. 9 is an illustrative phantom rear view of a service jacket fitted with a harness of the type disclosed herein, used in connection with a lifting strap 60. In using the lifting strap 60, the outer shell of the coat is lifted, exposing the torso loop 44 disposed at the rear of the harness wearer. The belt portion 62 is then looped over torso loop 44 and passed between the wearer's legs. The front shell panel of the coat is then raised and one of the carabiners snapped to the torso loop on one side of the wearer, the other carabiner being similarly connected to the other side. The wearer is then in a position to be hoisted or lowered by means of handle loop 46. The use of the lifting strap 60 in hoisting and lowering incapacitated victims is particularly useful since it holds the latter in a uniformly supported, substantially vertical position greatly facilitating carrying out the operation without injury.

Figure 10:
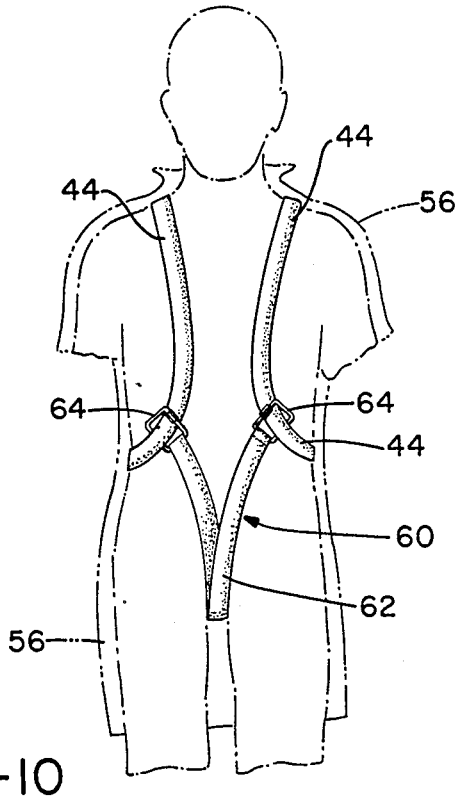
FIG. 10 is an illustrative phantom front view of the service jacket and lifting strap of FIG. 9.

FIG. 10 is an illustrative phantom front view of the service jacket and lifting strap of FIG. 9 showing how the end portions of the belt 62 are snapped to torso loop 44, on each side of the harness wearer by means of the carabiners 64.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be had to the following claims.

What is claimed is:

1. A safety apparatus, comprising:

a continuous loop of material connected to itself at a point to define a first larger loop and a second smaller loop;

a jacket having an outer shell and an inner liner said larger loop passing within said jacket between liner around a back portion of said jacket and said smaller loop extending out from said jacket and being maintained at a neck portion thereof, said larger loop passing from said back portion of said jacket to a front portion of said jacket below a point where arms extend from said jacket, said larger loop thence returning to said neck portion of said jacket; and a lifting strap having the ends thereof slidably looped over a part of said larger loop disposed at said back portion of said jacket, and for having said ends slidably fastened by connection means over said larger loop disposed at sides of said jacket after said strap passes between a wearer's legs.

* * * * *